US008745878B2

(12) United States Patent
Glesser

(10) Patent No.: US 8,745,878 B2
(45) Date of Patent: Jun. 10, 2014

(54) FOLDING KNIFE LOCKING MECHANISM WITH CARRIER DEVICE

(75) Inventor: Eric G. Glesser, Golden, CO (US)

(73) Assignee: Spyderco, Inc., Golden, CO (US)

( * ) Notice: Subject to any disclaimer, the term of this patent is extended or adjusted under 35 U.S.C. 154(b) by 617 days.

(21) Appl. No.: 12/244,151

(22) Filed: Oct. 2, 2008

(65) Prior Publication Data

US 2010/0083507 A1 Apr. 8, 2010

(51) Int. Cl.
*B26B 1/04* (2006.01)

(52) U.S. Cl.
USPC ..... 30/155; 30/160; 30/161

(58) Field of Classification Search
USPC ..... 30/161, 160, 157, 155
See application file for complete search history.

(56) References Cited

U.S. PATENT DOCUMENTS

| | | | | |
|---|---|---|---|---|
| 552,077 | A | 12/1895 | Wagner | |
| 557,818 | A | 4/1896 | Hotchkiss | |
| 749,230 | A | 1/1904 | Severance | |
| 1,194,503 | A | 8/1916 | Jawoisch | |
| 1,614,949 | A * | 1/1927 | Finley | 30/308.2 |
| 1,803,899 | A | 5/1931 | Fuller | |
| 1,864,011 | A | 6/1932 | Brown | |
| 1,994,215 | A | 3/1935 | Gaunt | |
| 2,415,367 | A | 2/1947 | Pavlovic | |
| 2,461,941 | A * | 2/1949 | Sutton | 294/26 |
| 2,481,309 | A | 9/1949 | Gunnarson | |
| D166,064 | S | 3/1952 | Blecher | |
| 2,630,114 | A | 3/1953 | Hart | |
| 3,006,443 | A | 10/1961 | Siler | |
| 3,263,329 | A | 8/1966 | Hennessy | |
| D224,388 | S | 7/1972 | Wood | |
| D224,389 | S | 7/1972 | Wood | |
| 3,731,961 | A | 5/1973 | Becker | |
| D227,071 | S | 6/1973 | Bernadotte | |
| 3,783,509 | A | 1/1974 | Lake | |
| 3,871,141 | A | 3/1975 | Bonapace | |
| D237,458 | S | 11/1975 | Laughlin | |
| 3,930,309 | A | 1/1976 | Collins | |
| 3,942,394 | A | 3/1976 | Juranitch | |
| 4,070,011 | A | 1/1978 | Glesser | |
| 4,083,110 | A | 4/1978 | Goldin et al. | |
| 4,133,106 | A | 1/1979 | Addis | |

(Continued)

FOREIGN PATENT DOCUMENTS

| | | |
|---|---|---|
| CA | 1130567 | 8/1982 |
| DE | 3041584 | 6/1982 |

(Continued)

OTHER PUBLICATIONS

"The Bud K Catalog", Bud K Worldwide, Early Fall 2000, p. 3, front and back cover.

(Continued)

*Primary Examiner* — Omar Flores Sanchez
(74) *Attorney, Agent, or Firm* — Sheridan Ross P.C.

(57) ABSTRACT

A folding knife locking mechanism is provided which maintains the open and closed positions associated with the folding knife. A carrier assembly for the locking mechanism for changing the folding knife from the closed to the open position is also disclosed. In one embodiment, the folding knife comprises a carrier assembly for positioning a spherical locking mechanism against the tang of the knife, without the need for scales or other retaining elements typical in prior art knives.

7 Claims, 5 Drawing Sheets

(56) References Cited

U.S. PATENT DOCUMENTS 4,170,061 A 10/1979 Henry
D256,427 S 8/1980 Lile
D256,981 S 9/1980 Sakurai
D257,056 S 9/1980 Spivey
4,231,194 A 11/1980 Glesser
D257,612 S 12/1980 Goldin et al.
4,266,591 A 5/1981 F'Geppert
4,272,887 A 6/1981 Poehlmann
4,347,665 A 9/1982 Glesser
4,393,539 A 7/1983 Weissman
4,394,096 A 7/1983 Stevens
4,447,950 A 5/1984 Mizelle
4,451,982 A 6/1984 Collins
D275,448 S 9/1984 Ferraro
D280,427 S 9/1985 Jones
4,604,803 A 8/1986 Sawby
4,640,058 A 2/1987 Glesser
D288,898 S 3/1987 Osterhout
4,696,129 A 9/1987 Roberts
4,703,560 A 11/1987 Brooker
4,719,700 A 1/1988 Taylor, Jr.
D296,518 S 7/1988 Sadler
4,759,153 A 7/1988 Cohen
4,776,094 A 10/1988 Glesser
4,778,094 A 10/1988 Fishback
4,805,303 A 2/1989 Gibbs
4,811,486 A 3/1989 Cunningham
4,819,289 A 4/1989 Gibbs
D302,649 S 8/1989 Porsche et al.
D302,650 S 8/1989 Giordano
D302,934 S 8/1989 Finn
D303,210 S 9/1989 Thompson
D304,154 S 10/1989 Osterhout
4,901,439 A 2/1990 Boyd, Jr.
D310,014 S 8/1990 Inman
4,947,551 A 8/1990 Deisch
4,947,552 A 8/1990 Barnes
D310,621 S 9/1990 Thompson
4,974,323 A 12/1990 Cassady
4,985,998 A 1/1991 Howard
D317,037 S 5/1991 Koshiishi
5,044,079 A 9/1991 Gibbs
5,060,379 A 10/1991 Neely
5,060,890 A 10/1991 Utterback et al.
D321,820 S 11/1991 Russell
D324,899 S 3/1992 Thompson
5,093,995 A 3/1992 Jan
5,095,624 A 3/1992 Ennis
5,111,581 A 5/1992 Collins
5,131,149 A 7/1992 Thompson et al.
D333,081 S 2/1993 Glesser
D333,251 S 2/1993 Glesser
D333,859 S 3/1993 Meyer
D337,253 S 7/1993 Glesser
D344,006 S 2/1994 Glesser
D347,375 S 5/1994 Sakai
D348,599 S 7/1994 Sakai
5,325,588 A 7/1994 Rogers
D349,837 S 8/1994 Glesser
D353,988 S 1/1995 Glesser
5,379,492 A 1/1995 Glesser
D356,723 S 3/1995 Sakai
5,400,509 A 3/1995 Collins
5,425,175 A 6/1995 Rogers
D363,871 S 11/1995 Coggins
D365,266 S 12/1995 Hasegawa
D366,408 S 1/1996 Sessions et al.
D367,599 S 3/1996 Sakai
5,495,673 A 3/1996 Gardiner et al.
5,495,674 A 3/1996 Taylor, Jr.
5,502,895 A 4/1996 Lemaire
5,511,310 A 4/1996 Sessions et al.
5,537,750 A 7/1996 Seber et al.
5,542,139 A 8/1996 Boivin
5,546,662 A 8/1996 Seber et al.
D373,716 S 9/1996 Keys et al.
5,572,793 A 11/1996 Collins et al.
5,580,019 A 12/1996 Glesser
5,581,888 A 12/1996 Lewis
D377,443 S 1/1997 Seber et al.
5,594,966 A 1/1997 Goldman
5,596,808 A 1/1997 Lake et al.
D378,982 S 4/1997 Thompson
5,615,484 A 4/1997 Pittman
D379,294 S 5/1997 Lum
5,628,117 A 5/1997 Glesser
D379,579 S 6/1997 Pohl
D381,060 S 7/1997 Moran
D382,189 S 8/1997 Viele
D382,459 S 8/1997 Khalsa
5,661,908 A 9/1997 Chen
D384,871 S 10/1997 McWillis
D385,173 S 10/1997 McWillis
D386,664 S 11/1997 Glesser
5,685,079 A 11/1997 Brothers et al.
5,689,890 A 11/1997 Glesser
D387,966 S 12/1997 Horn
D388,150 S 12/1997 Glesser
D389,389 S 1/1998 Glesser
D389,718 S 1/1998 Wegner
5,704,129 A 1/1998 Glesser
D391,465 S 3/1998 Glesser
D392,539 S 3/1998 Balolia
5,722,168 A 3/1998 Huang
5,737,841 A 4/1998 McHenry et al.
5,755,035 A 5/1998 Weatherly
D396,657 S 8/1998 Nagai et al.
D397,017 S 8/1998 Pardue
5,794,346 A 8/1998 Seber et al.
5,799,400 A 9/1998 Glesser
5,826,340 A 10/1998 Hull
D402,178 S 12/1998 Glesser
D402,524 S 12/1998 Glesser
D403,567 S 1/1999 Glesser
D404,990 S 2/1999 Zowada
D405,338 S 2/1999 Balolia
D407,002 S 3/1999 Morton et al.
5,878,500 A 3/1999 Emerson
5,887,347 A 3/1999 Gibbs
D411,431 S 6/1999 Glesser
D411,790 S 7/1999 Glesser
D412,355 S 7/1999 Saetherbo
5,920,935 A 7/1999 Beck
5,953,821 A 9/1999 Mearns
5,964,036 A 10/1999 Centofante
5,983,506 A 11/1999 Glesser
D418,383 S 1/2000 Bradichansky
D421,378 S 3/2000 Glesser
D422,871 S 4/2000 Terzuola
D425,391 S 5/2000 Bradichansky
6,088,861 A 7/2000 Sessions et al.
D429,138 S 8/2000 Glesser
6,101,722 A 8/2000 Cheng
6,101,723 A 8/2000 Ford
6,122,829 A 9/2000 McHenry et al.
6,125,543 A 10/2000 Jhones
D434,631 S 12/2000 Lum
D435,420 S 12/2000 Ayoob
6,154,965 A 12/2000 Sakai
D436,014 S 1/2001 Glesser
D438,443 S 3/2001 Keating
6,205,667 B1 3/2001 Glesser
D441,827 S 5/2001 Frank
D442,460 S 5/2001 Glesser
D442,461 S 5/2001 Glesser
D442,841 S 5/2001 Balolia
6,305,085 B1 10/2001 Stallegger et al.
6,338,431 B1 * 1/2002 Onion ..... 30/161
6,360,443 B1 3/2002 Remus
6,363,615 B1 4/2002 Moser
6,370,778 B1 4/2002 Conable
6,378,214 B1 * 4/2002 Onion ..... 30/161
6,397,477 B1 6/2002 Collins
D461,387 S 8/2002 Glesser

(56) References Cited

U.S. PATENT DOCUMENTS

| | | | | |
|---|---|---|---|---|
| 6,427,335 | B1 * | 8/2002 | Ralph | 30/161 |
| D464,551 | S | 10/2002 | Glesser | |
| 6,490,797 | B1 | 12/2002 | Lake et al. | |
| 6,523,265 | B2 | 2/2003 | Eickhorn | |
| 6,553,672 | B2 | 4/2003 | Glesser et al. | |
| D474,669 | S | 5/2003 | Onion | |
| 6,574,869 | B1 | 6/2003 | McHenry et al. | |
| 6,591,505 | B2 | 7/2003 | Flavigny | |
| 6,701,621 | B2 * | 3/2004 | Kain et al. | 30/160 |
| 6,725,545 | B2 | 4/2004 | Frank | |
| 6,751,868 | B2 | 6/2004 | Glesser | |
| D495,940 | S | 9/2004 | Keppel et al. | |
| 6,836,967 | B1 * | 1/2005 | Sakai | 30/161 |
| 6,918,184 | B2 | 7/2005 | Glesser | |
| D509,124 | S | 9/2005 | Keppel et al. | |
| 7,032,315 | B1 * | 4/2006 | Busse | 30/153 |
| D520,843 | S | 5/2006 | Voros | |
| D523,317 | S | 6/2006 | Ryan et al. | |
| 7,249,417 | B2 | 7/2007 | Chu | |
| D553,467 | S | 10/2007 | Ryan | |
| 7,340,836 | B2 | 3/2008 | Whitemiller et al. | |
| D573,864 | S | 7/2008 | Glesser | |
| D581,240 | S | 11/2008 | Glesser et al. | |
| 2006/0168817 | A1 | 8/2006 | Kao | |

FOREIGN PATENT DOCUMENTS

| | | |
|---|---|---|
| DE | 3217529 | 1/1983 |
| DE | 3834295 | 7/1989 |
| FR | 2495-986 | 6/1982 |
| GB | 189822620 | 0/1898 |
| GB | 2084058 | 9/1980 |

OTHER PUBLICATIONS

"Ironstone", Catalog of Knives and Accessories, Fall/Winter 1995-1996, cover, pp. 6-7 and 10-13.
Catolog page featuring Gerber Knives, Winter 1995/96, p. 32.
"Dear Spyderco Customer" Letter from Spyderco, Inc., Nov. 1, 2006, 2 pages.
"To Our Valuable Distributors and Dealers" Letter from Spyderco, Inc., Nov. 1, 2006, 4 pages.
"SpyderEdge", Spyderco, Inc., 4th Quarter, 2001, pp. 1-6.
"Spyderco 2001 Dealer Catalog", Spyderco, Inc., 2001, 40 pages.
"Spyderco Y2K Dealer Catalog", Spyderco, Inc., 2000, 36 pages.
"Spyderco 2007 Product Guide", Spyderco, Inc., 2007, 74 pages.
"Spyderco 2007 Dealer Pricing", Spyderco, Inc., 2007, 4 pages.
"Spyderco Think About It . . . All God's Critters Have Knives", Spyderco, Inc. 1996.
"Welcome to the World of Spyderco", Spyderco Brochure, Spyderco, Inc., 1998, 42 pages.
"Spyderco 2001" Spyderco, Inc. 2001, 2 pages.
"Spyderco 2002" Spyderco, Inc. 2002, 3 pages.
"K.I.S.S. & P.E.C.K." website pages from www.crkt.com/kiss.html, dated Jun. 2, 2008, 3 pages.
"K.I.S.S. Knife from Columbia River Knife and Tool" website pages from http://www.shop.com/K__I__S__S__Knife__from__Columbia__River__Knife__and__Tool-33217878-p!.shtml, dated Jun. 3, 2008, 3 pages.

* cited by examiner

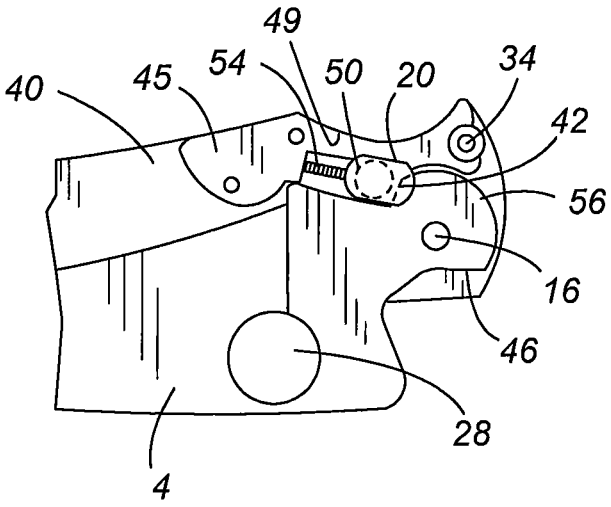
Fig. 6
Fig. 7
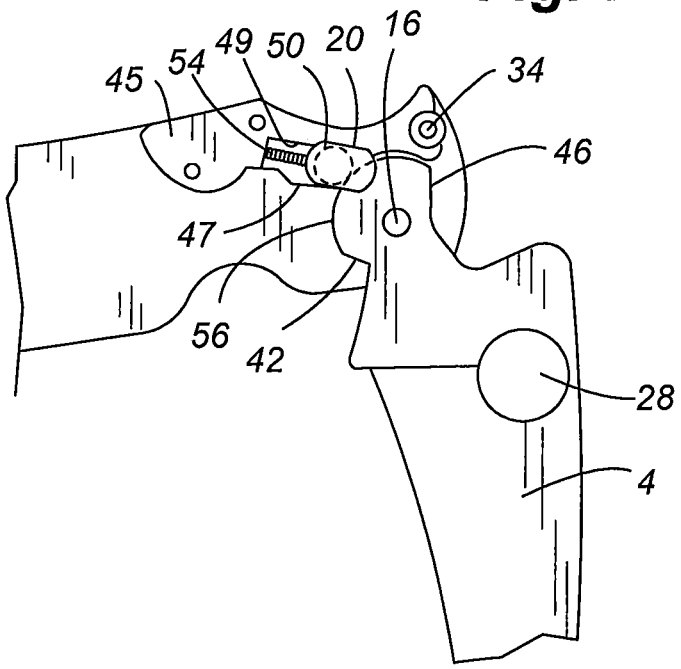

FOLDING KNIFE LOCKING MECHANISM WITH CARRIER DEVICE

FIELD OF THE INVENTION

The present invention is related to cutting instruments, and more specifically folding knives with locking mechanisms to maintain open and closed positions associated with the folding knife.

BACKGROUND OF THE INVENTION

Cutting instruments have been used for centuries by craftsmen, hunters, and others requiring a sharp cutting instrument. More recently, fixed length knives have been replaced with popular folding knives, which generally have two positions. In a first extended position of use, the knife cutting blade is extended to expose the blade cutting edge and permit cutting therein. In a second closed position, the cutting edge of the blade is stored within a cavity or recess in the handle portion of the knife, thus preventing the blade from being exposed. The folding mechanism further provides a cutting instrument which is much shorter in length than a typical fixed blade knife. Although these types of knives are extremely convenient, they can potentially become dangerous if the cutting blade does not have a locking mechanism to securely keep the knife blade in the first extended position of use. Likewise, it is often convenient to have a locking mechanism or some form of frictional retention device apparatus or detent to prevent the knife from inadvertently opening when the knife blade is in the second closed position. U.S. Pat. No. 6,751,868 discloses a folding knife with a substantially spherical locking mechanism, and is incorporated by reference herein in its entirety.

In particular, providing a carrier assembly for securing a locking mechanism which is integrated with at least one surface of a folding knife, which allows for travel between a first locked position and a second open position without the need for scales or other internal housing members, is desired.

Although there are other types of carrier assemblies and locking mechanisms used to prevent the inadvertent closure of a folding knife blade, none of these provide a means for retaining the locking mechanism without enclosing the locking mechanism within the handle portion of the folding knife, such as by enclosing the locking mechanism between a pair of scales, and otherwise are not simplistic to use, inexpensive to manufacture or essentially fail-proof. Thus, there is a need for a type of folding knife locking mechanism which provide these benefits and is simplistic to use, inexpensive to manufacture, and provides substantial strength to prevent any inadvertent failure. Further, the overall weight of the folding knife is reduced due to reduced materials.

There is also a need for an improved folding knife locking mechanism which is simplistic to assemble, uses a minimum number of components and is extremely reliable to prevent the inadvertent closure of the knife blade. There is an additional need for a carrier assembly and locking mechanism which are positioned to allow quick and easy manipulation by one or more of a user's fingers on either side of the folding knife.

SUMMARY OF THE INVENTION

It is thus an object of the present invention to provide a folding knife locking mechanism and associated carrier assembly which are secure and easily activated when the blade is in either an extended position of use or a closed position of storage. It is a further object of the present invention that the folding knife locking mechanism and carrier assembly be designed to use a minimum number of components, thus making the locking mechanism inexpensive to manufacture, simplistic in design, and encompassing a variety of different embodiments of a folding knife. It is also an object of the present invention to provide a locking mechanism that is near frictionless when between open and closed positions to allow the blade to either become positioned in an open or closed position with relative ease.

Thus, in one aspect of the present invention, a folding knife is provided which comprises a locking mechanism for preventing movement by engagement with at least one surface of the blade portion of the folding knife, thereby securing the folding knife in a first extended position of use. The folding knife according to this embodiment further prevents movements from a second closed position by engagement of the locking mechanism with at least one of the same surface or another surface of the blade.

In another aspect of the invention, the folding knife comprises a locking mechanism which comprises a carrier assembly positioned against at least one interior surface of the folding knife blade such that it encloses a locking mechanism for preventing the folding knife blade from pivoting away from a closed position or from an open position when the locking mechanism is in a first or normal position. When the folding knife blade is in a closed position, the carrier assembly further encloses the locking mechanism in a first position against a flat portion of the tang of the blade, thereby preventing the blade from pivoting about a blade pivot point and rotating the blade to an open position of use. Similarly, when the folding knife is in an open position, the carrier assembly encloses the locking mechanism in a second position against a straight portion of the tang, thereby preventing the blade from pivoting about a blade pivot point and rotating the blade to a closed position. As a user engages the carrier assembly and disengages the locking mechanism from the surface of the tang, the locking mechanism is moved to a position that allows the blade to pivot about the blade pivot point.

In one embodiment of the present invention, a locking mechanism that is enclosed by a carrier assembly comprises a spherical device such as a ball. Alternatively, it may comprise a plate, cylinder, elliptical, rectangle or any other imaginable shape which can be advanced by the carrier assembly to engage the tang or other surface of the knife, and also retracted to disengage the tang or other surface of the knife.

In one particular embodiment, the locking mechanism and carrier assembly are positioned to engage or "ride" one or more surfaces of the knife, for example, the tang of the blade, or an interior surface of the handle, such as an anvil, which are positioned in close proximity to the carrier assembly and locking mechanism so as to prevent the locking mechanism from becoming disengaged from the one or more surfaces of the knife. In one embodiment, the carrier assembly and locking mechanism engage more than one surface of the knife, and may depend on the position of the blade as discussed in greater detail herein.

Thus, in one particular aspect or embodiment of the present invention, a folding knife is provided which generally comprises:

a blade having a front end, a tang, an upper edge, and a cutting edge, the tang of the blade pivotally interconnected to a forward end of a handle;

a locking mechanism retained by a carrier assembly positioned proximate to the forward end of the handle for selectively locking the blade in a open position or a closed position, the carrier assembly moveable from a first forward locked position to a second retracted released position along a first surface of the handle;

wherein the locking mechanism engages a first surface of the tang when the carrier assembly is in the first forward locked position and the blade is in the closed position, and the locking mechanism disengages the first surface of the tang when the carrier assembly is in the second retracted released position, and the locking mechanism engages a second surface of the tang when the carrier assembly is in the first forward locked position and the blade is in the open position; and wherein the carrier assembly is retained against the first surface of the tang when the carrier assembly is in the first forward locked position and the blade is in the closed position, and the carrier assembly is retained against the first surface of the handle when the carrier assembly is in the second retracted released position, and the carrier assembly is retained against the second surface of the tang when the carrier assembly is in the first forward locked position and the blade is in the open position.

According to another embodiment of the present invention, a folding knife is provided, which generally comprises:

a blade having a front end, a tang, an upper edge, and a cutting edge, the tang of the blade pivotally interconnected to a forward end of a handle, the handle further comprising two scales;

a locking mechanism coupled to a carrier assembly and positioned against the first anvil for selectively locking the blade in a open position or a closed position, the carrier assembly moveable from a first forward locked position to a second retracted released position;

a first anvil positioned between the two scales and proximate to the carrier assembly;

a second anvil positioned between the two scales, opposite the first anvil and proximate to the carrier assembly;

wherein the locking mechanism engages the tang when the carrier assembly is in the first forward locked position and the blade is in the closed position, and the locking mechanism disengages the tang when the carrier assembly is in the second retracted released position, and the locking mechanism engages the tang when the carrier assembly is in the first forward locked position and the blade is in the open position;

wherein the locking mechanism is retained by the carrier assembly, the first anvil and the tang when the blade is in the closed position; and wherein the locking mechanism is retained by the carrier mechanism, the first anvil and the second anvil when the blade is in the open position.

BRIEF DESCRIPTION OF THE DRAWINGS

FIG. 6 is a detailed sectional view of the folding knife of FIG. 3;

FIG. 7 is a detailed sectional view of the folding knife of FIG. 3 shown in a partially open position;

The figures are not necessarily drawn to scale.

DETAILED DESCRIPTION

Figure 1:
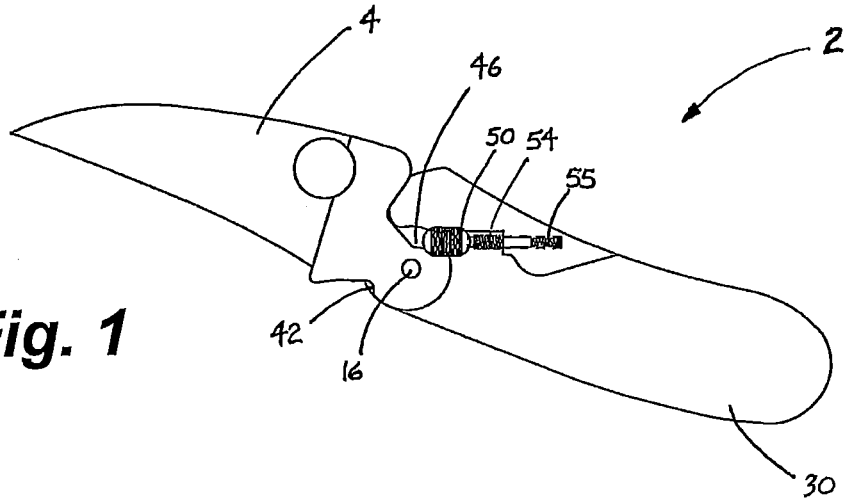
FIG. 1 is a front elevation view of a folding knife, according to one embodiment of the invention.
Figure 2:
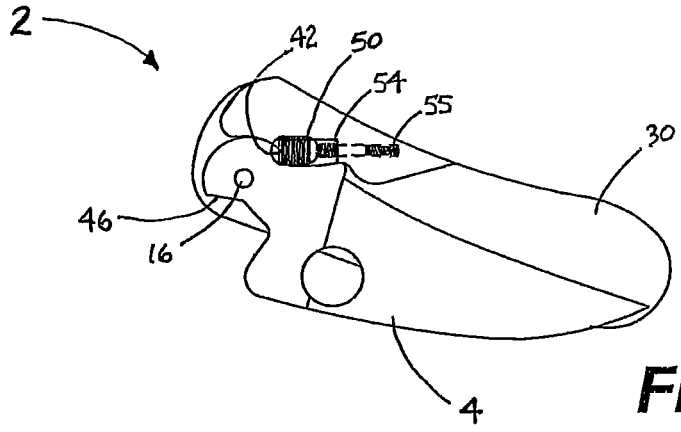
FIG. 2 is a front elevation of the folding knife of FIG. 1, shown in a closed position.

As described in detail below, various embodiments of the present invention include novel folding knife designs and configurations, comprising a locking mechanism and carrier assembly and/or other features. Referring now to FIGS. 1-2, a folding knife 1 according to one embodiment of the present invention is shown. The folding knife 2 comprises a blade 4 attached to a handle 30, the blade pivotable about a blade pivot point 16 allowing the blade 4 to be positioned in a closed (FIG. 2) or open (FIG. 1) position, and pivoted therebetween. The rear or tang portion of the blade 4 may include an arcuate surface proximate to a blade pivot point 16, the arcuate surface terminating in an abrupt flat surface when the blade 4 is in the open position of use, as shown in FIG. 1. When the knife 1 is in the position as shown in FIG. 1, a locking mechanism 50 is positioned so that the locking mechanism 50 is biased to prevent rotation of the blade 4 about blade pivot point 16. More specifically, the locking mechanism utilizes a ball, plate, sphere or other mechanism which engages a first or flat surface 42 of the tang of the blade 4 (as shown in FIG. 2), thus preventing rotation of the knife blade until the locking mechanism 50 is retracted. Once the locking mechanism 50 is retracted from the flat surface 42 of the tang of the blade 4, the blade is free to rotate about blade pivot point 16, until the locking mechanism 50 engages a second or straight surface 46 of the tang of the blade 4 (as shown in FIG. 1), thereby locking the blade 4 in the open position. The orientation and movement of locking mechanism 50 is described in greater detail below. Locking mechanism 50 may be biased by one or more biasing members 54,55, which bias the locking mechanism 50 in a direction to secure blade 4 in either a closed or open position, and which may be compressed to permit locking mechanism 50 to disengage the flat surface 42 or straight surface 46 and allow the blade 4 to rotate about blade pivot point 16 to a open (as shown in FIG. 1) or closed position (as shown in FIG. 2).

Figure 3:
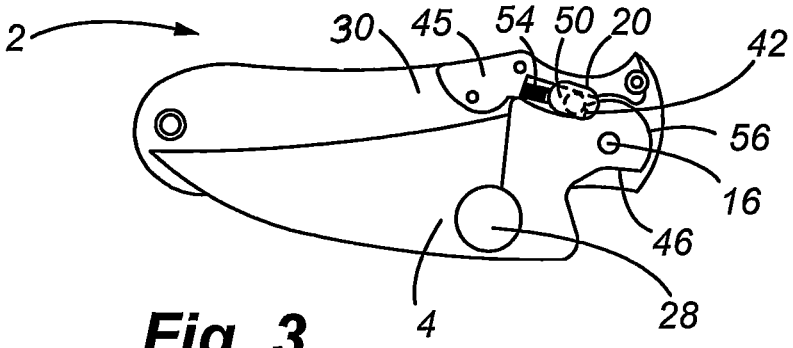
FIG. 3 is a rear elevation view of a folding knife, according to another embodiment of the invention, depicting a modified blade and spine configuration for the knife of FIGS. 1-2.

FIG. 3 depicts a folding knife comprising a blade 4 coupled to a handle 30 at a blade pivot point 16, which is attached to a portion of the blade 4 generally referred to as the tang, and which is comprised of multiple surfaces. A first or flat surface 42 of the tang is shown here positioned against a locking mechanism 50, which is coupled to a carrier assembly 20, and may be positioned to allow movement of the blade 4 about blade pivot point 16 as described herein. The tang further comprises a curvilinear portion or surface 56 of tang which allows the locking mechanism 50 to slide in a near frictionless arrangement thereby allowing the blade 4 to be extended to an open position of use quickly and easily. The tang further comprises a straight surface 46 which engages the locking mechanism 50 once the blade 4 has pivoted about blade pivot point 16 to a final position for use, thereby securing the blade 4 in its open position.

In a preferred embodiment, a carrier assembly 20 is coupled to a biasing member 54 which biases the carrier assembly 20 and locking mechanism 50 against the tang portion of the blade 4. The carrier assembly 20 is further coupled to an anvil 45, which is positioned against an interior surface 40 of handle 30. The positioning of the carrier assembly 20 to the biasing member 54, the anvil 45, and the tang portion of the blade 4 allows for a locking mechanism 50 to be secured and retained to the components described herein, without requiring an additional exterior surface, such as scales. Thus, FIG. 3 generally depicts the various components required for the locking mechanism as described in greater detail in reference to the description of FIGS. 5A-D and 6-10.

Figure 4:
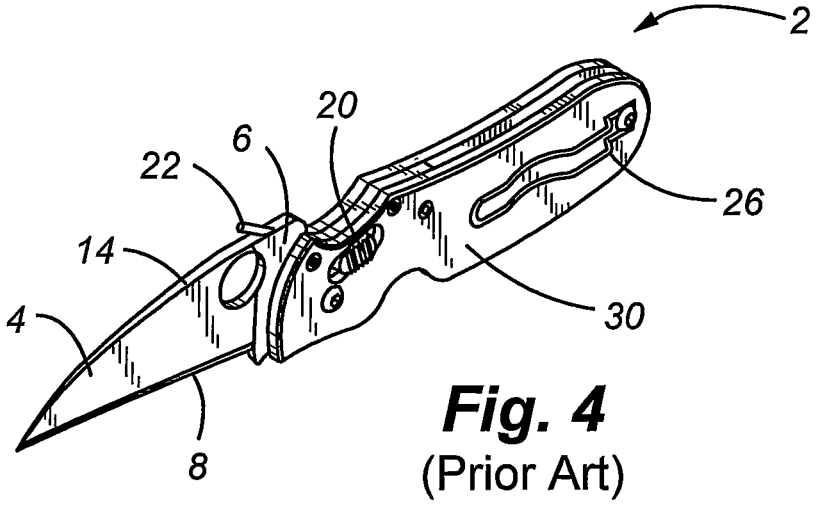
Fig. 4 (Prior Art)
FIG. 4 is a front perspective view of a prior art folding knife.

FIG. 4 generally depicts a folding knife 2 according to a prior art embodiment in a first extended position with the knife blade available for use. In general, the folding knife according to this prior art embodiment comprises a blade 4 attached to a handle 30 by a tang 6. The blade 4 is generally comprised of a cutting edge 8 opposite a spine 14. Prior art folding knife may further comprise a carrier assembly 20 for housing a locking mechanism for locking the blade 4 in either an extended position of use, as shown in FIG. 4, or a closed position. Prior art folding knife thus is selectively movable between an open and closed position by providing a blade 4, pivotally attached to a handle 30, which may rotate about a fixed point on the handle 30 to be positioned in either a closed position, or an extended or open position of use, as depicted in FIG. 4. This prior art folding knife, according to one embodiment, may further be secured in either a closed or an open position of use by positioning the carrier assembly 20 in a first or second position, either preventing or allowing rotation of the blade. However, the prior art folding knife requires additional components and parts, such as scales, to hold the carrier assembly 20 and locking mechanism in place, unlike the knife of FIGS. 1-3 described above.

Referring again to the knife of FIGS. 1-2, the carrier assembly 20 is movable from a first or locked position to a second or open position in a generally longitudinal direction, thus allowing a user to secure the blade 4 in an open or closed position. The carrier assembly 20 is comprised of a locking mechanism which also moves from a first or locked position to a second or open position upon movement of the carrier assembly 20. To allow selective rotation of the knife blade with respect to the handle 30, the carrier assembly 20 may be comprised of a variety of different locking mechanisms as described in greater detail in relation to FIGS. 5A-D and 6-10 below. As the carrier assembly 20 is moved away from the blade to a second position, the locking mechanism is also moved to a second position, thereby disengaging the locking mechanism from the tang 6 of the blade 4, and allowing the blade 4 to pivot about the blade pivot point 16 (as described in greater detail in relation to FIGS. 6-10 below).

As shown in FIGS. 5A-5D, the carrier assembly 20 according to various embodiments is generally comprised of two wings 21 surrounding a locking mechanism 50 and positioned to ride along a portion of the tang 56 of the blade of the knife during travel from a first position to a second position. At the opposite end of the carrier assembly 20 from the portion of the tang 56 is a stem 59, which in a preferred embodiment is coupled to a biasing member 54, shown in FIG. 5A as a compression spring. The wings 21 each have a carved out section on an interior surface or "relief" for capturing the locking mechanism 50 and holding it in place adjacent to the portion of the tang 56. The locking mechanism 50, shown here as a sphere, is also held in place by the anvil 45 (as shown in FIG. 6), which prevents movement of the locking mechanism 50 except as limited by the generally longitudinal path of travel defined by the location of the anvil 45 and the surface 56 of the tang of the blade 4 adjacent the carrier assembly 20. In addition to the contours provided by wings 21 for enclosing locking mechanism 50 (shown in FIG. 5A as a sphere), the portion of the tang 56 which contacts the locking mechanism 50 may be slightly concave 57, and thereby provide another means for enclosing the locking mechanism 50 between the carrier assembly 20 and the concave surface 57 of the portion of the tang 56.

In use, this configuration allows the carrier assembly 20 and locking mechanism 50 to travel in a generally longitudinal direction along at least one interior surface 40 of the folding knife 2, and selectively be positioned in either a first or second position, and thereby allowing the surface of the tang 56 to selectively be retained or to rotate about the blade pivot point 16. The locking mechanism 50 "rides" along the surface 56 of the tang between a first and a second position, allowing a user to secure the blade 4 in either a position of use or a stored position. The carrier assembly 20 also engages and partially encloses a surface of the tang 56 during the rotation of the blade 4 about blade pivot point 16, as described in greater detail below in relation to FIGS. 6-8.

Figure 5A:
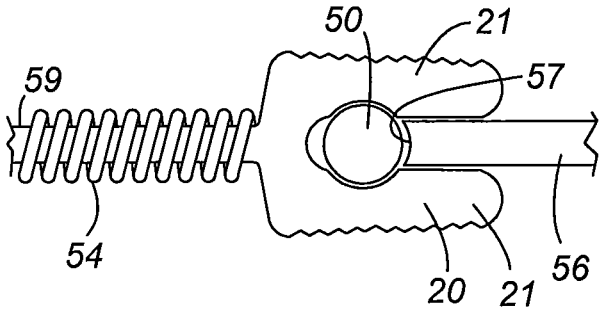
FIG. 5A is a detailed sectional top plan view of the carrier assembly and locking mechanism according to the embodiment shown in FIGS. 1-2.

This configuration provides several advantages over prior art knives. For example, the locking mechanism 50, here shown as a sphere, no longer needs to be enclosed between surfaces of handle or machined sections of a folding knife, often referred to as scales, which are formed into the interior surface of the handle portions of the folding knife 2. This configuration allows a locking mechanism 50 to potentially be provided on a folding knife having a reduced number of components, and otherwise without any scales or other machined parts to enclose or confine movement of the locking mechanism 50, such as a spherical object (as shown in FIG. 5A).

Figure 5B:
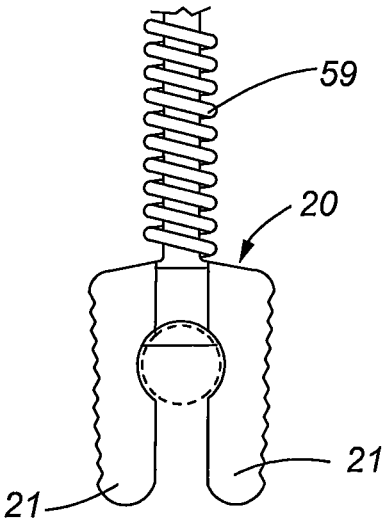
FIG. 5B is a top plan view of the carrier assembly according to one embodiment of the invention.
Figure 5C:
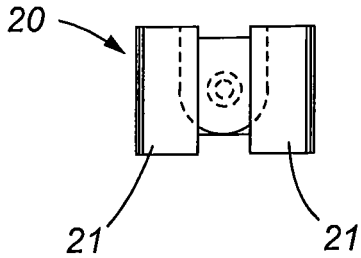
FIG. 5C is a front elevation view of the carrier assembly according to the embodiment of the invention shown in FIG. 5B.

FIGS. 5B-C depicts the carrier assembly 20 in a slightly modified configuration. FIG. 5B shows the carrier assembly 20, which is comprised of two wings 21 and a stem 59, and may further comprise a biasing member. The wings 21 are formed to permit a generally spherical object, such as a ball, to be inserted and retained within the carrier assembly 20, but exposed on a top and bottom plane of the carrier assembly 20 for contacting the tang of the blade 4 as described above. The outer surfaces of each of the wings 21 may comprise a textured or grooved surface (as shown in FIG. 5B) for accommodating contact by a finger of a user. FIG. 5C shows the carrier assembly 20 of FIG. 5B in a front elevation view. As seen from this perspective, the wings 21 of the carrier assembly 20 are spaced somewhat closer than the diameter of the recess for retaining the locking mechanism (not shown), and therefore serve to retain the locking mechanism about the horizontal axis (of FIG. 5C).

Figure 5D:
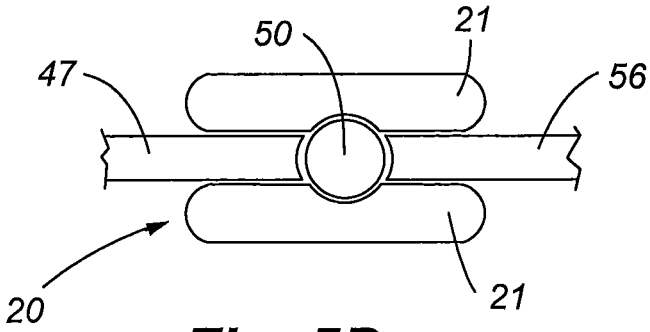
FIG. 5D is a detailed sectional top plan view of the carrier assembly according to yet another embodiment of the invention.

FIG. 5D shows a top plan view of a carrier assembly according to one alternative embodiment. In this embodiment, wings 21 of carrier assembly 20 are not connected by a stem, and further do not comprise a biasing member. This embodiment still allows a locking mechanism 50 to be retained by the carrier assembly 20 by two wings 21, which also serve to retain the locking mechanism 50 against the tang 56 and a retaining surface 47 of the handle 30 (as described in greater detail below in connection with FIGS. 6-10).

Although previous drawing figures have shown a folding knife 2 which comprises a handle 30, it is contemplated that a folding knife 2 according to one embodiment of the present disclosure will include a blade 4 that may be coupled to a significantly modified handle, different from the handle depicted in FIG. 4 of a prior art folding knife, including but not limited to a handle comprised of only a first surface 36, but that still has the ability to secure the blade 4 in a closed position or an open position as described above (i.e., provides a blade attachment or pivot point and ability to recess the blade). The essential characteristics of the folding knife 2 according to this embodiment include the carrier assembly 20, the locking mechanism 50, and the ability to pivot the blade 4 about a fixed point and secure the blade 4 in multiple positions. By providing a locking mechanism 50, and associated carrier assembly 20 described herein, a knife may be constructed with these locking and unlocking features and at the same time greatly reduce the necessary parts and components previously required of folding knives.

Although the locking mechanism 50 described in relation to FIGS. 5A-D is a sphere, other embodiments are disclosed herein, which provide a similar carrier assemblies, but using different shaped locking mechanisms to secure the blade in a closed or open position. By way of example but not by limitation, the locking mechanism may be comprised of various shapes or elements, such as a ball, a block, a cylinder, a cube, a pin, or a peg. The positioning of the carrier assembly 20, the anvil 45, the locking mechanism 50, and the portion of the tang 56 as described herein provide the framework to prevent the locking mechanism 50 and carrier assembly 20 from becoming disengaged or removed from the knife housing.

Referring now to FIG. 6, a detailed partial sectional view of the folding knife 2 of FIG. 1 (in a closed position) is shown. Carrier assembly 20 comprises a locking mechanism 50 which is positioned against the anvil 45, which is coupled to an interior surface 40 of the handle 30 of the folding knife 2 such that it encloses locking mechanism 50 and is secured within the folding knife 2 and adjacent the interior surface 40 of folding knife 2. When the folding knife 2 is in a closed position the carrier assembly 20 retains locking mechanism 50 in a locked position against a flat portion 42 of the tang, thereby preventing the blade 4 from pivoting about blade pivot point 16 and extending to an open position of use. This contact is caused in part by biasing member 54. As a user engages the carrier assembly 20, and moves the carrier assembly 20 to a second position (in the opposite direction of the force provided by biasing member 54), the locking mechanism 50 is disengaged from the flat surface 42 of the tang, thereby allowing the blade 4 to pivot about blade pivot point 16. This is also caused in part by the detent, and the force required upon the carrier assembly 20 to move from a first position to a second position to allow the blade 4 to rotate. Thus, as shown in FIG. 6, the carrier assembly 20 is shown in a first or secured position, but may be moved in a way to compress the biasing member 54 and disengage the tang of the blade 4, thereby allowing the folding knife 2 to be extended for use. Anvil 45 further comprises a stop pin 34 for preventing rotation of the blade 4 beyond the desired range of motion (namely from an open extended position of use to a closed position).

Referring now to FIG. 7, another detail partial sectional view of the folding knife 2 is shown. Here the blade 4 is in a partially extended position such that the tang still engages the locking mechanism 50 of the carrier assembly 20, yet engages the locking mechanism 50 along a surface 56 of the tang so that it may slide smoothly in a clockwise or counter-clockwise direction when viewed as shown in FIG. 7, to either an open or extended position of use, or a closed or stored position. Also shown in FIG. 7, the interior surface 40 of handle 30 further comprises a retaining surface 47 for retaining the locking mechanism 50 against the anvil 45, and further permitting the locking mechanism 50 to prevent rotation of the blade 4 when the blade 4 is in the closed position (as shown in FIG. 6). This retaining surface 47 is sometimes referred to as a "back spacer." The close proximity and configuration of flat surface 42 of the tang of the blade 4 and the retaining surface 47 of the handle 30 allow the locking mechanism 50 to become wedged between the two surfaces when the locking mechanism 50 is biased towards the normal position (as shown in FIG. 6), thereby preventing rotation of the blade 4 prior to disengaging the locking mechanism 50 from the flat surface 42 of the tang of the blade 4.

Figure 8:
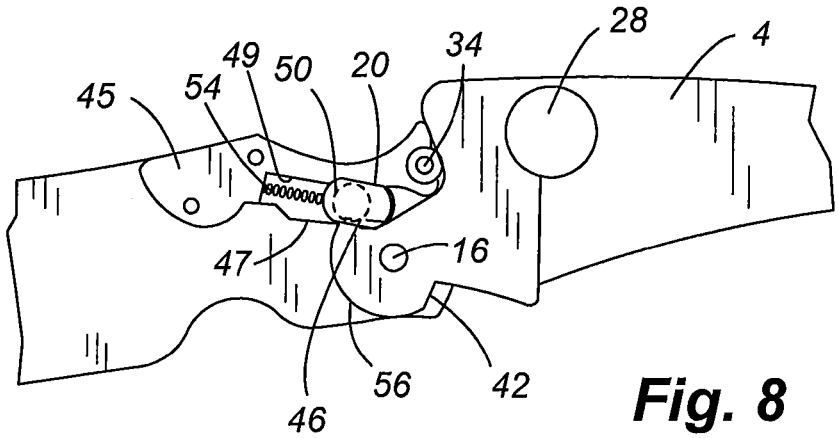
FIG. 8 is another detailed sectional view of the folding knife of FIG. 3 in an opened position.

Referring now to FIG. 8, a detail partial sectional view of the folding knife 2 in an open position is shown. Here, the blade 4 is shown in a completely extended position, and biasing member 54 has forced the locking mechanism 50 to travel past the surface 56 of the tang of the blade 4, and abut a straight surface 46 of the tang. In this position, the locking mechanism 50 of the carrier assembly 20 prevents the folding knife 2 from pivoting about blade pivot point 16 so that the blade 4 is fixed in an extended position of use. A user may engage the carrier assembly 20 and direct the carrier assembly 20 in a direction against the biasing force of biasing member 54, thereby disengaging the locking mechanism 50 from the straight surface 46 of the tang, and allow the blade 4 to pivot about lock pivot point 16, and thereby be pivoted back to a closed position as shown in FIG. 6.

Figure 9:
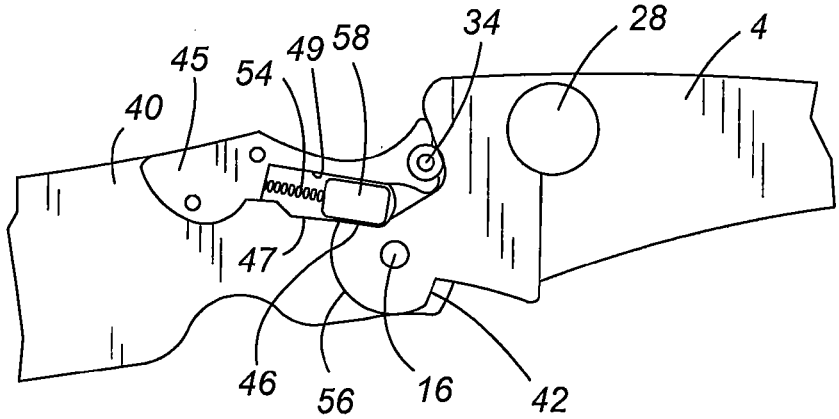
FIG. 9 is a detailed sectional view of the folding knife according to one alternative embodiment.

Referring now to FIG. 9, a carrier assembly 20 in an alternative embodiment is shown with the folding knife 2 in an open position. As shown in FIG. 9, for convenience, the carrier assembly 20 and wings 21 have been removed to show a generally rectangular locking mechanism 58, thereby replacing the spherical member or locking mechanism 50 as described in relation to FIGS. 5A-D. Similar to the operation of the locking mechanism 50 of the carrier assembly 20 as described in the preceding paragraphs, this generally rectangular locking mechanism 58 may move from a second closed position to a first or open position by directing the carrier assembly 20 against the biasing force of the biasing member 54, and disengaging the rectangular locking mechanism 58 from the straight surface 46 of the tang. The generally rectangular shape also allows a smooth contact between the surface 56 of the tang, thereby allowing the blade 4 to freely move from either an open or extended position of use to a closed or secured position.

Figure 10:
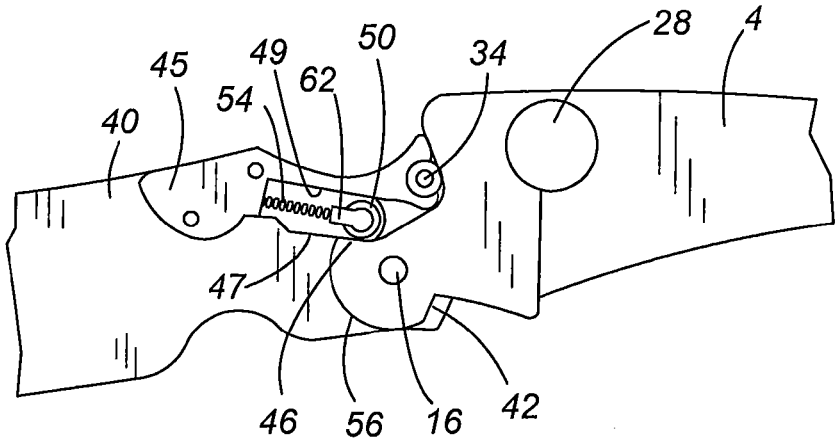
FIG. 10 is a detailed sectional view of the folding knife according to yet another alternative embodiment.

Referring now in detail to FIG. 10, yet another alternative embodiment for the carrier assembly locking mechanism is shown. In this embodiment, the spherical locking mechanism 50 is coupled to the biasing member 54 in a slightly modified way, to allow a more free or frictionless motion as folding knife 2 is moved from an open position of use to a closed or secured position. In this embodiment, locking mechanism 50 is held in place by a retaining arm 62 that is coupled to biasing member 54. In one particular embodiment, the retaining arm 62 extends only on one side of the retention device. In yet another alternative embodiment, a pair of retaining arms 62 may be positioned, diametrically opposed to each other, to envelop locking mechanism 50 and thereby secure a connection between locking mechanism 50 and biasing member 54.

In these embodiments, the locking mechanisms 50, 58 are modified to either eliminate or become integrated with the carrier assembly previously described. Thus, according to the embodiments of FIGS. 9 and 10, the locking mechanisms 50, 58 are secured or retained in part by the allowed path of travel of the locking mechanisms 50, 58, defined by the anvil 45 and the flat portion 46 of the tang, and also in part by the constant force provided by the biasing member 54. The biasing member 54 is in constant tension, thereby causing the locking mechanisms 50, 58 to be limited in movement along a generally longitudinal direction against the interior surface 40 of the knife. Therefore, in these alternative embodiments (FIGS. 9, 10), the folding knife comprises means for engaging the locking mechanisms 50, 58 with the tang 6 of the blade 4 without the carrier assembly 20 and wings 21 engaging the tang.

Although the locking mechanisms 50, 58 of FIGS. 9 and 10 are shown without a carrier assembly 20 as described in relation to FIGS. 1-3 above, it is contemplated that folding knives according to these embodiments (FIGS. 9, 10) may be further comprised of modified carrier assemblies in addition to the modified locking mechanisms 50, 58. Alternatively, the locking mechanisms 50, 58 of FIGS. 9 and 10 may be provided without a carrier assembly, and engaged by a user directly.

To provide further clarity to the detailed description provided herein in the associated drawings, the following list of components and associated numbering are provided as follows:

| Component No. | Component |
|---|---|
| 02 | Folding Knife |
| 04 | Blade |
| 08 | Cutting Edge (of Blade) |
| 14 | Spine (of Blade) |
| 16 | Blade Pivot Point |
| 20 | Carrier Assembly |
| 21 | Wing(s) (of Carrier Assembly) |
| 26 | Clip |
| 28 | Finger Aperture |
| 30 | Handle |
| 34 | Stop Pin |
| 40 | Interior Surface (of Handle) |
| 42 | Flat Surface (of Tang) |
| 45 | Anvil (of Handle) |
| 46 | Straight Surface (of Tang) |
| 47 | Retaining Surface (of Handle) |
| 48 | Contour (of Handle) |
| 50 | Locking Mechanism |
| 54, 55 | Biasing Member(s) |
| 56 | Surface (of Tang) |
| 57 | Concave Surface (of Tang) |
| 58 | Rectangular Locking Mechanism |
| 59 | Stem (of Carrier Assembly) |
| 62 | Retaining Arm |

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the claims be construed to include alternative embodiments to the extent permitted by the prior art.

What is claimed is:

1. A knife comprising:

a blade having a front end, a tang, an upper edge, and a cutting edge, said tang of said blade pivotally interconnected to a forward end of a handle;

an anvil positioned adjacent to said tang of said blade and positioned adjacent said forward end of said handle;

a locking mechanism comprising a sphere;

said locking mechanism retained by a carrier assembly positioned proximate to said forward end of said handle for selectively locking said blade in an open position or a closed position, said carrier assembly moveable from a first locked position to a second released position;

said locking mechanism retained only by said carrier assembly and at least one of the following:

said tang of said blade;

said anvil; and said handle of said knife;

a biasing member coupled to said carrier assembly which biases said carrier assembly towards said first forward locked position;

wherein said sphere engages a first surface of said tang when said carrier assembly is in said first locked position and said blade is in said closed position, and said sphere disengages said first surface of said tang when said carrier assembly is in said second released position, and said sphere a second surface of said tang when said carrier assembly is in said first forward locked position and said blade is in said open position; and wherein a portion of said carrier assembly extends in a direction substantially parallel to a longitudinal plane of said blade over a peripheral portion of said tang such that a surface of said peripheral portion is substantially parallel to a surface of said portion of said carrier assembly, and wherein said surface of said peripheral portion is substantially orthogonal to said first surface of said tang when said blade travels between said open position and said closed position to assure said carrier assembly travels in said direction substantially parallel to said longitudinal plane of said blade.

2. The knife as claimed in claim 1 wherein said locking mechanism and said carrier assembly are integrated into a single piece movable from a first locked position to a second released position.

3. The knife as claimed in claim 1 wherein said tang of said blade is comprised of a concave surface about the outer circumference of said tang to receive said sphere.

4. The knife as claimed in claim 1 wherein said locking mechanism is biased by said biasing member towards said first locked position to prevent rotation of said blade when said blade of said knife is in either said closed position or said open position.

5. The knife as claimed in claim 4 wherein said carrier assembly is further comprised of:

two wing elements about a first end of said carrier assembly for further retaining said locking mechanism and for selectively enveloping said peripheral portion of said tang when said carrier assembly is in said first forward locked position; and a stem element about a second end opposite of said first end of said carrier assembly, for coupling with said one biasing member in a mating configuration for biasing said carrier assembly towards said first locked position when said blade is in either said closed position or said open position.

6. The knife as claimed in claim 5 wherein said knife is completely devoid of scales.

7. A knife comprising:

a blade having a front end, a tang, an upper edge, and a cutting edge, said tang of said blade pivotally interconnected to a forward end of a handle;

an anvil positioned adjacent to said tang of said blade and positioned adjacent said forward end of said handle;

a locking mechanism retained by a carrier assembly positioned proximate to said forward end of said handle for selectively locking said blade in an open position or a closed position, said carrier assembly moveable from a first locked position to a second released position;

said locking mechanism retained only by said carrier assembly and at least one of the following:

said tang of said blade;

said anvil; and said handle of said knife;

said carrier assembly comprising:

two wing elements about a first end of said carrier assembly for retaining said locking mechanism and for capturing a peripheral portion of said tang when said carrier assembly is in said first locked position; and a stem element about a second end opposite of said first end of said carrier assembly, for coupling with at least one biasing member in a mating configuration for biasing said carrier assembly towards said first locked position when said blade is in either said closed position or said open position;

wherein said locking mechanism engages a first surface of said tang and a portion of said handle when said carrier assembly is in said first locked position and said blade is in said closed position, and said locking mechanism disengages said first surface of said tang and said portion of said handle when said carrier assembly is in said second released position, and said locking mechanism engages a second surface of said tang and said portion of said handle when said carrier assembly is in said first forward locked position and said blade is in said open position; and wherein said two wing elements of said carrier assembly extend in a forward direction over said peripheral portion of said tang such that a first surface of said peripheral portion is substantially parallel to a surface of one of said two wing elements.

* * * * *